United States Patent [19]

Melfi

[11] Patent Number: 4,862,992

[45] Date of Patent: Sep. 5, 1989

[54] NOISE BARRIER

[75] Inventor: Nicholas W. Melfi, Manlius, N.Y.

[73] Assignee: Concrete Pipe & Products, Corp., E. Syracuse, N.Y.

[21] Appl. No.: 245,707

[22] Filed: Sep. 19, 1988

[51] Int. Cl.[4] ..... E04H 17/00

[52] U.S. Cl. ..... 181/210; 181/284; 181/296; 405/272

[58] Field of Search ..... 181/210, 284, 296; 52/114, 194, 282, 296; 160/229.1; 248/679; 256/19, 31, 55; 405/272, 275

[56] References Cited

U.S. PATENT DOCUMENTS

| | | | |
|---|---|---|---|
| 2,974,910 | 3/1961 | Lynn | 244/114 B |
| 3,307,809 | 3/1967 | Lynn | 244/114 R |
| 3,321,160 | 5/1967 | Turnbull | 52/114 X |
| 4,162,596 | 7/1979 | Bamman | 248/679 X |
| 4,218,859 | 8/1980 | Sams | 52/194 |
| 4,282,693 | 8/1981 | Merklinger | 52/282 |
| 4,331,314 | 5/1982 | Chacour et al. | 248/679 |
| 4,558,850 | 12/1985 | Melgi | 181/210 X |
| 4,605,090 | 8/1986 | Melgi | 181/210 |

*Primary Examiner*—B. R. Fuller

*Attorney, Agent, or Firm*—Wall and Roehrig

[57] ABSTRACT

A concrete post assembly and method of mounting same. The post assembly is supported in upright position by an inground pier in which a plurality of anchor bolts are embedded with a portion of each bolt extending upwardly above the upper surface of the pier. The post assembly includes a concrete post and a base plate rigidly secured to the bottom of the post, the base plate having a plurality of holes located so as to register with upwardly extending anchor bolts. A nut is threaded onto each anchor bolt and the post assembly is mounted on the bolts with its base plate resting on the nuts which can then be adjusted to level the plate. A second set of nuts are threaded onto the anchor bolts and tightened against the upper surface of the base plate to lock the post assembly in mounted position.

7 Claims, 1 Drawing Sheet

NOISE BARRIER

BACKGROUND OF THE INVENTION

This invention relates generally to noise barrier walls, and has particular reference to an improved post assembly for such a wall and a method of securing the post assembly in position.

At the present time, barrier walls are frequently erected alongside super highways and freeways to shield nearby homes from traffic noises. One well-known type of wall construction is the post and panel type wherein spaced apart posts or columns are formed with grooves to hold intermediate, flat concrete panels in place. Such a construction is disclosed in applicant's Patent No. 4,605,090, issued Aug. 12, 1986. A second type of noise barrier wall construction, not as pertinent to the present invention, is disclosed in applicant's earlier Patent No. 4,558,850, issued Dec. 17, 1985.

The applicant's own Patent No. 4,605,090 is the closest prior art known to him. Additional prior art patents noted in the course of a preliminary search are U.S. Pat. Nos. 2,974,910; 3,307,809; 3,321,160; 4,218,859 and 4,282,693.

SUMMARY OF THE INVENTION

The present invention provides for a concrete post assembly and method of mounting same that is particularly adapted for use in noise barrier walls, but is by no means limited to such use. The post assembly is constructed so as to be supported in upright position by an in-ground concrete pier, the upper surface of which terminates a short distance below ground level. A plurality of anchor bolts are partially embedded in the pier with a portion of each bolt extending upwardly above the upper surface of the pier.

The post assembly includes a concrete post and a rigid base plate that is fixed to the bottom of the post as by embedding upwardly projecting rebars in the post when it is cast, the rebars being fixed to the base plate. The base plate has a plurality of holes that are located so as to register with the upwardly extending anchor bolts.

The anchor bolts are threaded and a nut is placed on each bolt at the approximate height it is desired to have the post base plate positioned. Thereafter, the post assembly is mounted on the anchor bolts with the base plate resting on the nuts and the latter are adjusted so that the post assembly is vertically disposed and extends the desired distance above the ground. A second set of nuts is then threaded on the anchor bolts and tightened against the upper surface of the post base plate to lock the post assembly in mounted position. After mounting the post assembly as just described, a concrete topping is added to the top of the in-ground pier so that the post plate is at least partially embedded in concrete and the top of the pier is substantially flush with the ground level.

DESCRIPTION OF THE PREFERRED EMBODIMENT

Figure 1:
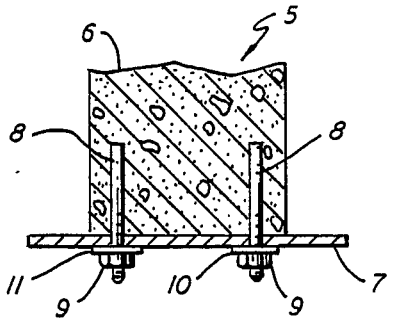
FIG. 1 is a side elevation, partially in section, of a post assembly mounted on an in-ground pier.
Figure 2:
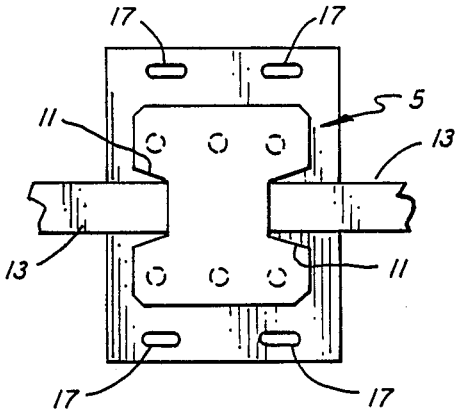
FIG. 2 is an enlarged vertical sectional view of the post assembly taken on line 2—2 of FIG. 3.

Having reference now to the drawings, and with particular reference to FIGS. 1 and 2, the post assembly is generally indicated at 5 and comprises a concrete post 6 and a relatively heavy metal base plate 7 that is rigidly secured to the post as by threaded rods (rebars) 8 that are embedded in the post when it is cast. The rebars are fixed to the base plate as by welding or by nuts 9 and washers 10 as shown in FIG. 2. The post 6 is formed with grooves 11 on opposite sides for receiving and holding the edges of flat concrete panels 13 as described in applicant's Patent No. 4,605,090.

Figure 3:
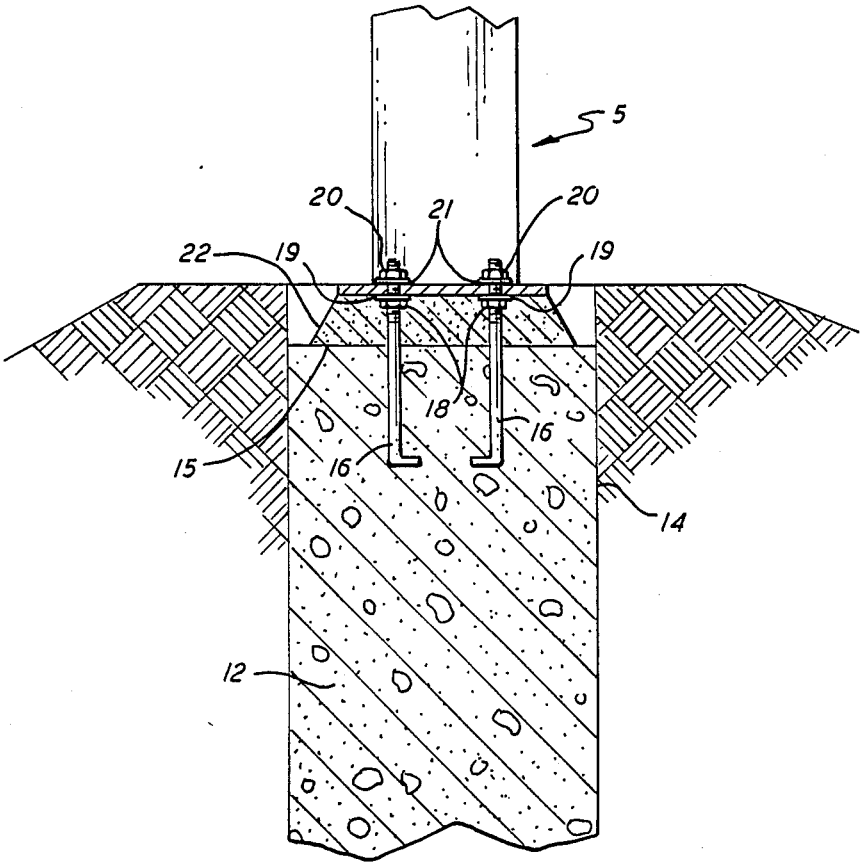
FIG. 3 is an enlarged top plan view of the post assembly.

The post assembly 5 is supported in upright position by an in-ground concrete pier 12, FIG. 3, that is preferably cast in place in a cylindrical bore 14 in the ground. As can be seen in the drawing, the upper surface 15 of the pier terminates a short distance below ground level. A plurality of generally J-shaped anchor bolts 16 are embedded in the pier 12 when it is cast and these extend above the upper surface 15 of the pier, the upwardly extending portions of the bolts being threaded.

Using a jig, template or the like, the anchor bolts 16 are located in the pier so as to be in registry with holes 17, FIG. 2, in the base plate 7, the holes being elongated to allow for minor inaccuracies. In mounting the post assembly on the anchor bolts, nuts 18 and washers 19 are first threaded on the bolts, FIG. 1, at the approximate height it is desired to have the base plate positioned. The post assembly is then mounted on the anchor bolts with the lower surface of the base plate resting on the nut and washer assemblies as shown. The nuts can be adjusted up or down as necessary to make the base plate level and align the post 6 in a vertical position. The positioning of the nuts 18 also provides a minor adjustment for the height that post 6 extends above the ground.

After the base plate 7 has been leveled, a second set of nuts 20 and washers 21 are mounted on the anchor bolts and the bolts tightened against the upper surface of the base plate to rigidly secure the post assembly in position. Finally, a nonshrinkable concrete or grouting material 22 is poured on top of the pier 12 beneath the base plate to provide a pedestal upon which the post rests.

In assembly, the top of the base plate is situated flush with or slightly above ground level. Accordingly, when a panel is slidably received in one of the post grooves it will come to rest on the top of the base plate thus supporting and automatically leveling the panel in assembly.

From the foregoing description it will be apparent that the invention provides an improved post assembly and method of mounting same, the assembly having a simplified, yet very advantageous construction. As will be understood by those familiar with the art, the invention may be embodied in other specific forms without departing from the spirit or essential characteristics thereof.

What is claimed is:

1. A concrete post assembly for use in a noise barrier wall, the post assembly being adapted to be supported in an upright position by an in-ground concrete pier, the post assembly comprising:

a plurality of anchor bolts embedded in the pier with a threaded portion of each bolt extending above an upper surface of the pier;

support means threaded onto the upwardly extending portion of each anchor bolt for supporting a concrete post assembly thereon;

a rigid base plate fixed to a bottom of the post and having a plurality of holes located therein that are in registry with the upwardly extending anchor bolts, the base plate and post being mounted on the anchor bolts with the plate resting on said support means above the upper surface of the pier, said support means on the anchor bolts being adjusted so that the plate is level and the post extends a desired height above the upper surface of the pier;

nut means threaded on each anchor bolt above the base plate to rigidly secure the plate between the nut means and the support means; and said base plate being affixed to the bottom of the concrete post by rods secured to the plate which extend upwardly and are embedded within the post.

2. The post assembly of claim 1 further including a non-shrinkable topping added to the upper surface of said pier after the base plate and post have been secured in position on the anchor bolts for providing a pedestal upon which the base plate rests.

3. A concrete post assembly for use in a noise barrier wall that includes:

an in-ground concrete pier having a top surface terminating a short distance below ground level;

a plurality of anchor bolts embedded in the pier with a threaded portion of each bolt extending above the top surface of said pier;

support means threaded onto the upwardly extending portion of each anchor bolt for supporting a concrete post thereon;

a rigid base plate affixed to a bottom of the post having a plurality of holes located therein that are in registry with the upwardly extended anchor bolts, said base plate and said post being mounted on the anchor bolts with the plate resting on said support means above the upper surface of said pier, said support means being adjusted on said anchor bolts so that the plate is level and the post extends a desired distance above the upper surface of said pier;

locking means mounted on each anchor bolt above the base plate for rigidly securing the plate against said support means; and a non-shrinkable topping added to the top surface of said pier to provide a pedestal upon which said base plate rests.

4. The post assembly of claim 3 wherein said support means is adjusted so that the plate is at or above ground level.

5. The post assembly of claim 4 wherein the concrete post contains vertically disposed grooves in opposing side walls thereof and further including panel means slidably received within said grooves, said panel means resting upon said base plate.

6. A method of securing a concrete post assembly used in a noise barrier wall in a desired position, the post assembly including a rigid base plate affixed to a bottom of a concrete post, said post further including vertical grooves formed in the opposing side walls thereof, the method comprising the steps of:

casting in place within an in-ground bore a concrete pier having a top surface which terminates at or below ground level, said pier having a plurality of threaded anchor bolts partially embedded therein with a threaded portion of each bolt extending above the top surface of said pier;

threading a support means on each anchor bolt;

mounting the base plate of a post assembly on the anchor bolt so that the base plate rests upon the support means with the post extending upwardly above the top surface of said pier;

adjusting the position of the support means on the anchor bolts so that the base plate is at or above ground level;

locking the base plate securely against the support means to hold the post in an upright position; and adding a non-shrinkable topping to the top surface of the pier so that the base plate rests upon said topping.

7. The method of claim 4 that further includes the step of inserting side panels into the opposed grooves formed in the post so that each panel rests upon the top of the base plate.

* * * * *

UNITED STATES PATENT AND TRADEMARK OFFICE

CERTIFICATE OF CORRECTION

PATENT NO. : 4,362,992

DATED : September 5, 1989

INVENTOR(S) : NICHOLAS W. MELFI

It is certified that error appears in the above—identified patent and that said Letters Patent is hereby corrected as shown below:

Col. 4, line 40, please change "4" to --6--.

Signed and Sealed this

Twenty-second Day of October, 1991

*Attest:*

HARRY F. MANBECK, JR.

*Attesting Officer*

*Commissioner of Patents and Trademarks*